US008938173B2

(12) United States Patent
Sasaoka

(10) Patent No.: US 8,938,173 B2
(45) Date of Patent: Jan. 20, 2015

(54) FIXING APPARATUS

(75) Inventor: Osamu Sasaoka, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 345 days.

(21) Appl. No.: 13/032,133

(22) Filed: Feb. 22, 2011

(65) Prior Publication Data

US 2011/0206388 A1 Aug. 25, 2011

(30) Foreign Application Priority Data

Feb. 24, 2010 (JP) ..... 2010-038897

(51) Int. Cl.
*G03G 15/00* (2006.01)
*G03G 15/20* (2006.01)

(52) U.S. Cl.
CPC .... *G03G 15/2085* (2013.01); *G03G 2215/2035* (2013.01)
USPC ..... 399/21; 399/68; 399/323

(58) Field of Classification Search
CPC ..... G03G 15/2085
USPC ..... 399/67, 21, 33, 68, 122, 323, 322, 400
See application file for complete search history.

(56) References Cited

U.S. PATENT DOCUMENTS

| | | | | |
|---|---|---|---|---|
| 6,615,017 | B2 * | 9/2003 | Tanaka | 399/322 |
| 7,693,471 | B2 * | 4/2010 | Kikuchi et al. | 399/323 |
| 7,702,270 | B2 * | 4/2010 | Yoshida | 399/323 |
| 2002/0037186 | A1 | 3/2002 | Tanaka | |

FOREIGN PATENT DOCUMENTS

| | | |
|---|---|---|
| JP | 60-50547 | 3/1985 |
| JP | 61-088162 | 6/1986 |
| JP | 5-297666 | 11/1993 |
| JP | 2002-099174 | 4/2002 |
| JP | 2006-248761 | 9/2006 |
| JP | 2008-122449 | 5/2008 |

* cited by examiner

*Primary Examiner* — Matthew G Marini
(74) *Attorney, Agent, or Firm* — Fitzpatrick, Cella, Harper & Scinto

(57) ABSTRACT

A fixing apparatus for fixing an image formed on the recording material, includes: a fixing rotatable member for forming a fixing nip; and wrapping preventing members, each provided downstream of the nip with respect to a feeding direction of the recording material, for preventing the recording material from wrapping around the rotatable member. When the recording material is jammed downstream of the fixing nip, the wrapping preventing members move to narrow the space from the rotatable member to the wrapping preventing members by being pushed by the jammed recording material. The wrapping preventing members are arranged in a direction substantially perpendicular to the recording-material feeding direction. Also provided is a connector for connecting adjacent wrapping preventing members to move, when one is pushed by the jammed recording material, to narrow the space.

18 Claims, 11 Drawing Sheets

FIXING APPARATUS

FIELD OF THE INVENTION AND RELATED ART

The present invention relates to a fixing apparatus that is mountable in an image forming apparatus such as a copying machine and a printer.

An image forming apparatus which uses such a recording technology as an electrophotographic process, an electrostatic process, and the like, transfers a toner image onto a recording medium, and then, fixes the toner image (unfixed image) to the recording medium by applying heat and pressure to the recording medium and the toner image thereon.

A fixing apparatus sometimes suffers from such a problem as a paper jam that causes the fixing apparatus to fail to properly convey the recording medium through the fixing apparatus. If a paper jam occurs in a fixing apparatus, there is no place for recording medium to be conveyed. Consequently, recording medium is forced into the heating unit and/or pressing unit, being wrapped around the heat roller and/or pressure roller. In other words, a fixing apparatus sometimes needs to be restored.

Thus, some fixing apparatuses are provided with a member for preventing the recording medium from being wrapped around a heating unit. One of such fixing apparatuses is disclosed in Japanese Laid-open Patent Application 2002-99174. In the case of this fixing apparatus, the member for preventing the recording medium from wrapping around the heating unit (heat roller) is on the downstream side of the heating nip in terms of the recording-medium conveyance direction. Shown in FIG. 8 is an example of a member 102 for preventing recording medium from being wrapped around a heating unit. The member 102 for preventing the recording medium from being wrapped around the heating unit is on the downstream side of the nip between the heating unit 10 and pressing unit 11 of the fixing apparatus. The member 102 is rotationally movable about an axis, and is kept pressured by a spring 104 toward the recording-medium conveyance passage of the fixing apparatus.

More specifically, referring to FIG. 9, the fixing apparatus is structured so that when it is in the normal condition in the state of recording-medium conveyance, the wrapping prevention member 102 is kept separated from the heating unit 100, whereas when the amount of force applied to the wrapping prevention member 102 is greater than the normal amount, the wrapping prevention member 102 is placed in contact with, or moved into the adjacencies of, the heating unit 100 by the force applied to the wrapping prevention member 102 by the sheet P, whereby the recording medium is prevented by the wrapping prevention member 102 from entering the heating unit 100. This fixing apparatus, however, suffered from the following problem. That is, if the wrapping prevention member 102 is inaccurate in dimension, the amount of pressure, which the wrapping prevention member 102 applies to the heating unit 100 as it is pressed by a jammed piece of paper or the like, is liable to become excessive enough to damage the heating unit 100, or it fails to contact the heating unit 100, allowing thereby the sheet P to slip by.

In order to ensure that a jammed sheet of paper or the like is prevented from wrapping around the heating unit 100, it is necessary to provide a fixing apparatus with a wrapping prevention member (102) which is as long as the heating unit 100 in terms of the widthwise direction of the recording medium (direction perpendicular to the recording-medium conveyance direction). However, a wrapping prevention member (102) that is as long as the heating unit 100 is problematic in that it is liable to warp, and therefore, is difficult to be kept accurately positioned relative to the heating unit 100.

As a means for preventing the wrapping prevention member (102) from warping, in order to keep the wrapping prevention member (102) precisely positioned relative to the heating unit 100, it is possible to provide a fixing apparatus with multiple (two, for example) smaller wrapping prevention members 102*a* and 102*b* which are parallel to the heating unit 100, as shown in FIG. 10, instead of providing the fixing apparatus with the single long wrapping prevention member (102).

However, if a paper jam or the like occurs to a fixing apparatus having the two smaller wrapping prevention members 102*a* and 102*b*, each of the two members 102*a* and 102*b* is moved into its position in which it remains in contact with, or its position in which it remains separated from, the heating unit 100, independently from the other, as shown in FIG. 11. Thus, it is possible that the two wrapping prevention members 102*a* and 102*b* become different in position, creating thereby a gap between the two members 102*a* and 102*b*. If a jammed paper or the like happens to enter this gap, the wrapping prevention member which is in its normal position, that is, the position in which it remains separated from the heating member 100 is prevented from returning to its position in which it remains in contact with the heating member 100. If even one of the wrapping prevention members 102*a* and 102*b* fails to return to its normal position, it is liable for the recording medium to enter the heating unit 100 through the gap.

SUMMARY OF THE INVENTION

The present invention was made to solve the above-described problem. Thus, the primary object of the present invention is to provide a fixing apparatus which has multiple members for preventing a recording medium from wrapping around the heating unit, and/or pressing unit, of the fixing apparatus, and yet, does not suffer from the problem that the recording medium wraps around the heating and/or pressing unit.

According to an aspect of the present invention, there is provided a fixing apparatus for fixing an image formed on the recording material, comprising a fixing rotatable member for forming a fixing nip, a plurality of wrapping preventing members, each provided downstream of the fixing nip with respect to a feeding direction of the recording material, for preventing the recording material from wrapping around said fixing rotatable member, wherein when the recording material is jammed downstream of the fixing nip, the wrapping preventing members move to narrow the space from the fixing rotatable member by being pushed by the jammed recording material, wherein the wrapping preventing members are arranged in a direction substantially perpendicular to the recording-material feeding direction. The apparatus also comprises a connecting portion for connecting adjacent ones of the wrapping preventing members to move, when one of the wrapping preventing members is pushed by the jammed recording material, also adjacent one of wrapping preventing members to narrow the space.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

Hereinafter, the fixing apparatuses and image forming apparatuses in the preferred embodiments of the present invention are described with reference to the appended drawings.

<General Structure of Image Forming Apparatus>

Figure 1:
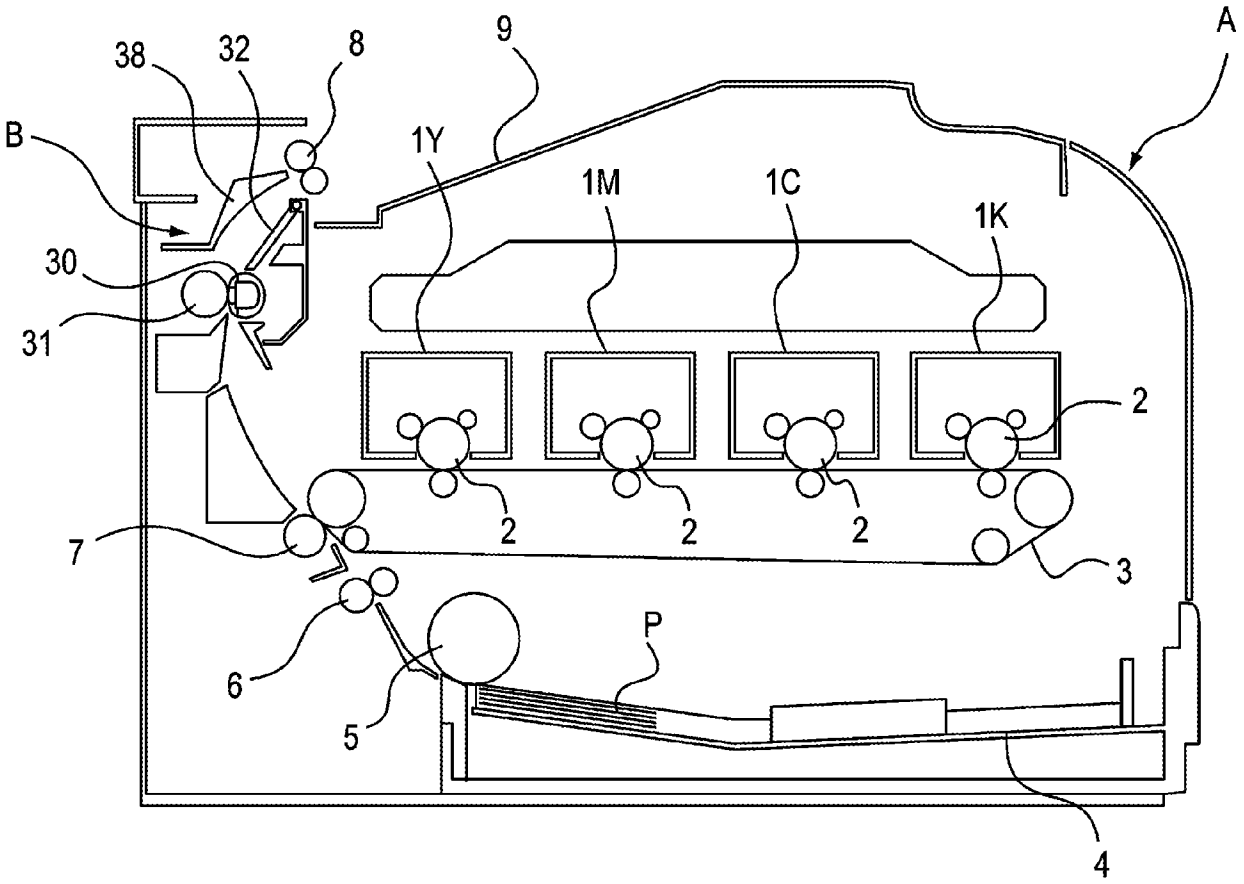
FIG. 1 is a schematic sectional view of a laser beam printer, which is an example of an image forming apparatus equipped with a fixing apparatus in accordance with the present invention, in the first embodiment of the present invention. It shows the general structure of the image forming apparatus.

FIG. 1 is a schematic sectional view of a laser beam printer, which is an example of an image forming apparatus equipped with a fixing apparatus in accordance with the present invention. It shows the general structure of the image forming apparatus.

The image forming apparatus A in this embodiment is a laser beam printer that forms images with the use of an electrophotographic method. To describe the general structure of the image forming apparatus along with the image-forming operation of the apparatus, there are four process cartridges 1Y, 1M, 1C, and 1K in the image-forming portion of the apparatus. Each process cartridge contains a photosensitive drum, a developing device, etc., and is removably mountable in the image forming portion. To describe the image forming operation of the apparatus, first, yellow, magenta, cyan, and black toner images are formed on the four photosensitive drums in the four process cartridges, one for one. Then, a full-color toner image is formed on the intermediary transfer belt 3 of the apparatus by the sequential transfer of the four toner images, different in color, from the photosensitive drums onto the intermediary transfer belt 3. Then, the full-color toner image is transferred onto a recording medium (a sheet of paper, which is going to be referred to simply as a sheet). More specifically, while the full-color image is being formed, one of the sheets P in a sheet cassette 4, which is in the bottom portion of the main assembly of the image forming apparatus, is conveyed to the second transfer portion of the apparatus by a sheet feeder roller 5 and a pair of recording-medium conveyance rollers 6 with such a timing that the sheet P arrives at the second transfer portion at the same time as the full-color toner image arrives at the second transfer portion. Then, while the sheet P is conveyed through the second transfer portion, the full-color toner image on the intermediary transfer belt 3 is transferred onto the sheet P by applying bias to a second transfer roller 7.

After the transfer of the full-color toner image onto the sheet P, the sheet P is conveyed to the fixing apparatus B, which is above the second transfer portion. Then, while the sheet P is conveyed through the fixing apparatus B, the sheet P and the full-color toner image thereon are subjected to heat and pressure, whereby the full-color toner image is fixed to the sheet P. Then, the sheet P is discharged into a delivery tray 9 by a pair of discharge rollers 8 while being guided by sheet guiding members 32 and 38.

<Fixing Apparatus>

Next, the fixing apparatus B in this embodiment is described. The fixing apparatus B in this embodiment has: a heating means 30 for heating the sheet P and the full-color toner image thereon after the transfer of the full-color toner image onto the sheet P; and a pressure unit 31, which is pressed upon the heating means to form a heating nip (fixation nip). The fixing apparatus B fixes the full-color toner image to the sheet P by heating the sheet P and the full-color toner image thereon while conveying the sheet P through the nip.

Figure 2:
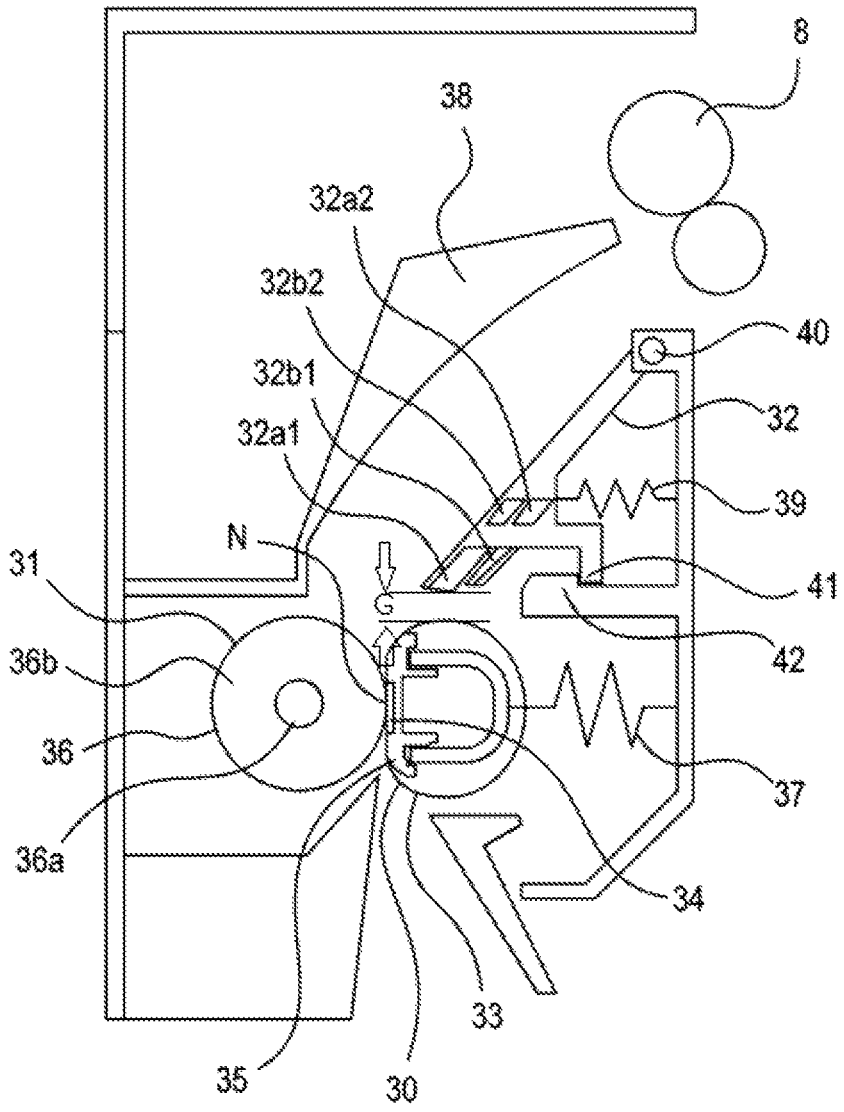
FIG. 2 is a schematic sectional view of the fixing apparatus in the first embodiment of the present invention when a recording medium is being normally conveyed through the fixing apparatus

Referring to FIG. 2, the heating unit 30, which is a sheet heating means, is made up of a cylindrical fixation film 33 (circularly movable member), a heater 34, and a stay 35. The fixation film 33, which is thin and cylindrical, is formed of highly heat-resistant and thermally conductive plastic or the like. The heater 34 is in contact with the inward surface of the fixation film 33 and heats the fixation film 33. The stay 35 is rigid and heat resistant. It also is in contact with the inward surface of the fixation film 33.

The heater 34 is a ceramic heater, or a carbon heater, for example. It is a heat generating member that is connected to an unshown electric power source, and generates heat as electric current flows through it. It is solidly supported by the stay 35 by being fitted in a groove of the stay 35. The fixation film 33 is fitted around the heater 34 and the stay 35, and is circularly movable.

Next, referring to FIG. 2, the pressing unit 31, which is a pressure applying means, is made up of a pressure roller 36 and a compression spring 37, etc. The compression spring 37 is for keeping the pressure roller 36 pressed upon the heating unit 30. The pressure roller 36 is made up of a metallic core 36*a* and an elastic layer 36*b*. The elastic layer 36*b* is cylindrical and heat resistant. It is molded so that it covers the entirety of the peripheral surface of the metallic core 36*a*. In other words, the surface layer of the pressure roller 36 is elastic. Therefore, as the pressure roller 36 is pressed upon the heating unit 30, a nip N is formed between the pressure roller 36 and heating unit 30. The nip N is preset in width in terms of the recording-medium conveyance direction, and also, is preset in internal pressure. The pressure roller 36 is rotated by an unshown power source at a preset peripheral velocity. As the pressure roller 36 is rotated, friction is generated between the fixation film 33 and pressure roller 36, whereby the fixation film 33 is rotated by the friction in a manner to follow the rotation of the pressure roller 36.

As the fixing apparatus B becomes ready for fixation, that is, when the pressure roller 36 is being rotated, the fixation film 33 is rotated by the rotation of the pressure roller 36, the temperature of the heater 34 is kept at a preset level by the electric current flowing through the heater 34, and the sheet P, on which the unfixed full-color toner image is borne, is conveyed through the nip N between the fixation film 33 and pressure roller 36, remaining pinched between the fixation film and pressure roller, while the nip N is kept at a preset level in temperature. Thus, while the sheet P is conveyed through the nip N, the heat from the heater 34 is given to the sheet P through the fixation film 33. Consequently, the unfixed full-color tone image is melted and fixed to the sheet P by the heat and pressure applied to the sheet P in the nip N.

(Wrapping Prevention Member: Member for Preventing Recording Medium from Wrapping around Heating Unit)

Figure 3:
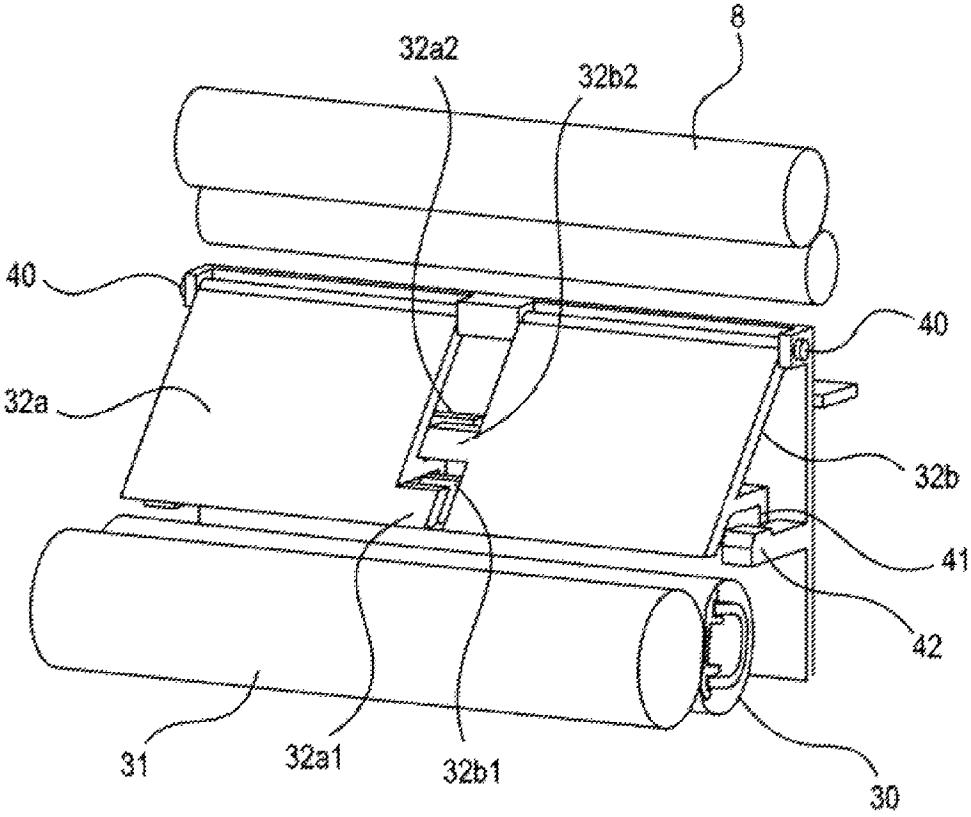
FIG. 3 is a perspective view of the fixing apparatus in the first embodiment of the present invention when a recording medium is being normally conveyed through the fixing apparatus.

After the sheet P is conveyed out of the heating nip N, it is separated from the pressure roller 36 by the curvature of the peripheral surface of the pressure roller 36. The fixing apparatus B is provided with a guiding means for guiding the sheet P after the sheet P is conveyed through the heating nip N. The guiding means is on the downstream side of the nip N in terms of the sheet-conveyance direction. Referring to FIG. 3, the guiding means is made up of multiple (two in this embodiment) guiding members 32 (32*a* and 32*b*), which are in alignment with each other in the widthwise direction of the sheet P, that is, the direction perpendicular to the sheet-conveyance direction.

In this embodiment, it is each of the guiding members 32 that plays the role of a member (wrapping prevention member) for preventing the sheet P from wrapping around the fixation film 33. However, the wrapping prevention member does not need to have a function of guiding the recording medium (sheet P). This is also true with the second and third embodiments of the present invention which will be described later.

The wrapping prevention member is a member for preventing the recording medium from wrapping around the rotational fixing member of the fixing apparatus B, and is on the downstream side of the fixation nip N in terms of the recording-medium conveyance direction, as described above.

After the sheet P is conveyed through the heating nip N, it is discharged into the delivery tray 9 by the pair of discharge rollers 8 while remaining pinched between the two discharge rollers 8 and being guided by the aforementioned guiding members 32*a* and 32*b*.

The guiding members 32*a* and 32*b* are attached to the main assembly of the fixing apparatus B in such a manner that they are rotationally movable about the axis 40. They are kept pressured by springs 39 toward the sheet-conveyance passage. When the sheet P is being normally conveyed through the fixing apparatus B, stoppers 41 are kept anchored to the stopper seat portions of the main assembly of the fixing apparatus B, by the springs 39. While the stoppers 41 remain anchored to the stopper seat portions 42, the edge of each of the guiding members 32*a* and 32*b* is not in contact with the heating unit 30 (there is a gap between the edge of guiding member and fixation film), and therefore, the guiding members 32*a* and 32*b* function as a member for guiding the sheet P after the sheet P is conveyed through the heating nip N.

The amount of the resiliency of the guide spring 39 is set to such a value that the amount of the force generated by the guide springs 39 allows the guiding members 32*a* and 32*b* to move to the heating unit 30 if the sheet P fails to be properly conveyed through the fixing apparatus B (for example, if the sheet P is jammed) after it is conveyed through the heating nip N, Thus, as the recording medium is jammed in the downstream portion (space) of the recording-medium passage in the fixing apparatus B in terms of the recording-medium conveyance direction, each of the wrapping prevention members moves by being pressed by the jammed recording medium, in the direction to narrow the gap (G in FIG. 2) between itself and the rotational fixing member.

Next, referring to FIG. 3, the guiding member 32*a* is provided with a pair of tabs 32*a*1 and 32*a*2, and the guiding member 32*b* is provided with a pair of tabs 32*b*1 and 23*b*2. More specifically, the pair of tabs 32*a*1 and 32*a*2 of the first guiding member 32*a*, and the pair of tabs 32*b*1 and 32*b*2 of the second guiding member 32*b*, are shaped and positioned so that as one of the guiding members 32*a* and 32*b* is rotationally moved by the jammed recording medium, the two pairs of tabs interlock with each other.

That is, the tab 32*a*1 of the first guiding member 32*a* is positioned closer to the sheet passage than the tab 32*b*1 of the second guiding member 32*b*. Further, the tab 32*b*2 of the second guiding member 32*b* is positioned closer to the sheet passage than the tab 32*a*2 of the first guiding member 32*a*. Therefore, as the guiding member 32*a* (32*b*) moves, the guiding member 32*b* (32*a*) is moved by the movement of the guiding member 32*a* (32*b*).

Since the fixing apparatus B is structured as described above, if the sheet P fails to be properly conveyed, for example, the sheet P becomes jammed between the nip N and pair of discharge rollers 8, after it is conveyed through the nip N, the sheet P presses on one or both of the guiding members 32*a* and 32*b* because the sheet P has no place to go.

Figure 4:
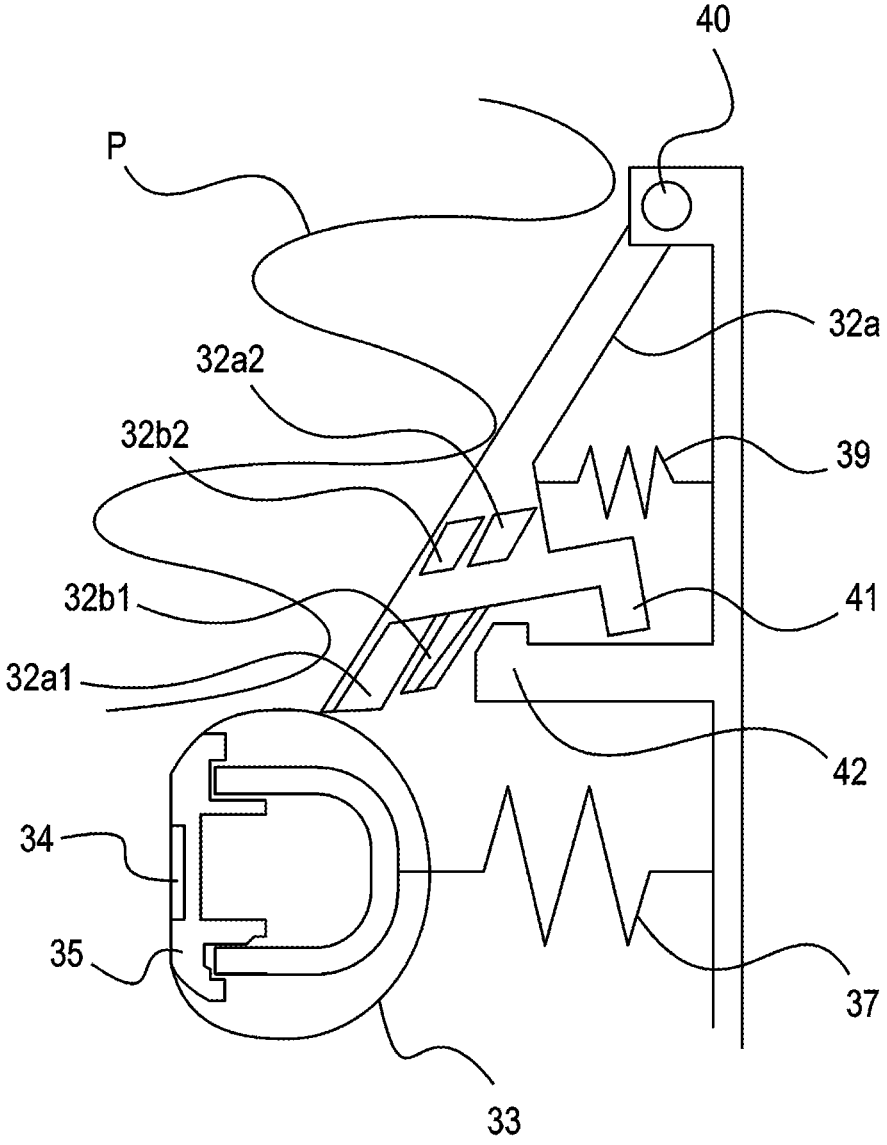
FIG. 4 is a schematic sectional view of the wrapping prevention member of the fixing apparatus in the first embodiment, and its adjacencies, of the fixing apparatus in the first embodiment, when the wrapping prevention member is in contact with the heating unit of the fixing apparatus because of the pressure from the jammed recording medium.

FIG. 4 is a schematic sectional view of the guiding members 32*a* and 32*b* and their adjacencies, when they are kept in contact with the heating unit 30 by the jammed sheet P. For example, if the amount of the force that the first guiding member 32*a* receives from the jammed sheet P is greater than the amount of the pressure that the first guiding member 32*a* receives from the springs 39, the guiding member 32*a* moves toward the heating unit 30. As the guiding member 32*a* moves toward the heating unit 30, the tabs 32*a*1 and 32*a*2 press on the tabs 32*b*1 and 32*b*2, respectively, and therefore, the second guiding member 32*b* is moved by the movement of the guiding member 32*a*, being thereby moved toward the heating unit 30 with the first guiding member 31*a*. That is, each wrapping prevention member has a pair of tabs, which interlock with the tabs of the adjacent wrapping prevention member so that as one of the guiding members 32*a* and 32*b* is pressed by the jammed recording medium (sheet P), the adjacent guiding member also is moved in the direction to reduce the gap between the guiding member and the rotational fixing member.

That is, the fixing apparatus B is structured so that as a sheet of a recording medium becomes jammed on the downstream side of the fixation nip N in terms of the recording-medium conveyance direction, the guiding members 32*a* and 32*b* are placed in contact with the heating unit 30 to block the sheet passage (the gap between guiding members 32 and heating unit 30) which allows the jammed sheet to wrap around the heating unit 30.

To summarize, the guiding means 32 of the fixing apparatus B in this embodiment is made up of two guiding members 32*a* and 32*b*, which are virtually half in size compared to a conventional guiding member 32, being therefore unlikely to warp. In other words, the shape and dimensions of the guiding means 32 in this embodiment, which is a combination of the guiding members 32*a* and 32*b*, is likely to remain more accurate than a conventional guiding member (32), and therefore, contacts, and remains in contact with the heating unit 30 more precisely than a conventional one, when the sheet P happens to become jammed.

Further, even though the guiding means 32 is made up of multiple (two) guiding members (32*a* and 32*b*), the multiple guiding members are structured so that as one of the multiple guiding members is moved by the jammed paper or the like, the other guiding member is moved by the first guiding member. Therefore, the guiding members are positioned and kept positioned with a higher level of accuracy, being therefore capable of ensuring that the sheet P is prevented from entering the heating unit.

Incidentally, in this embodiment, the fixing apparatus B is structured so that the guiding members 32*a* and 32*b* come into contact with the heating unit 30 to prevent the jammed sheet from entering the heating unit 30. However, it is possible to structure the fixing apparatus B so that the guiding members 32*a* and 32*b* come into contact with the pressing unit 31 to prevent the jammed sheet from entering the pressing unit 31.

Embodiment 2

Figure 5:
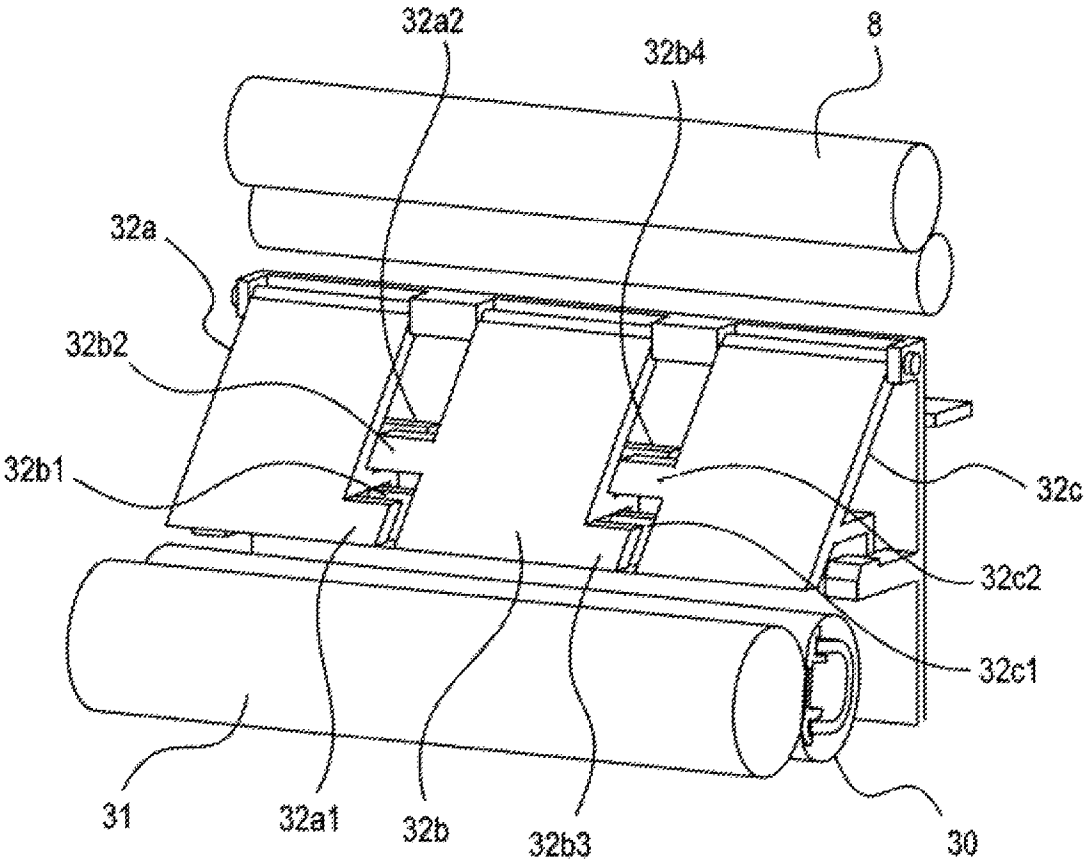
FIG. 5 is a perspective view of the fixing apparatus in the second embodiment of the present invention.

Next, referring to FIG. 5, the fixing apparatus in the second preferred embodiment of the present invention is described. The basic structure of the fixing apparatus in this embodiment is the same as that of the fixing apparatus in the first embodiment, and therefore, is not going to be described here, in order not to repeat the same description. Here, therefore, only the structural features of the fixing apparatus in this embodiment, which characterizes this embodiment, are described. Further, the structural components of the fixing apparatus in this embodiment, which are the same in function as the counterparts in the first embodiment, are given the same reference characters as those given to their counterparts, one for one.

In the first embodiment, the fixing apparatus B had two guiding members 32*a* and 32*b*. In this embodiment, the fixing apparatus B is provided with three guiding members. That is, it has one more guiding member than the fixing apparatus B in the first embodiment. More specifically, the guiding means in this embodiment is made up of three guiding members, that is, first, second, and third guiding members 32*a*, 32*b*, and 32*c*, respectively, which are in alignment in the lengthwise direction of the heating nip N. Further, the three guiding members 32*a*, 32*b*, and 32*c* are parallel to each other. The fixing apparatus is structured so that the three guiding members 32*a*, 32*b*, and 32*c* are rotationally movable amount the axis 40, and also, so that when the fixing apparatus is in a normal state of sheet conveyance, the stopper of each of the three guiding members 32*a*, 32*b*, and 33*c* is kept in contact with the corresponding stopper seat of the main frame of the fixing apparatus, by the corresponding spring 39.

Further, the first guiding member 32*a* is provided with a pair of tabs 32*a*1 and 32*a*2, and the second guiding member 32*b* is provided with a pair of tabs 32*b*1 and 32*b*2 and a pair of tabs 32*b*3 and 32*b*4. The third guiding member 32*c* is provided with a pair of tabs 32*c*1 and 32*c*2. The pair of tabs 32*a*1 and 32*a*2, the pair of tabs 32*b*1 and 32*b*2, the pair of tabs 32*b*3 and 32*b*4, and the pair of tabs 32*c*1 and 32*c*2 are shaped and positioned so that as one of the guiding members 32*a*, 32*b*, and 32*c* is moved by the jammed recording medium (paper), the pair of tabs 32*a*1 and 32*a*2 interlock with the pair of tabs 32*b*1 and 32*b*2, and the pair of tabs 32*b*3 and 32*b*4 interlock with the pair of tabs 32*c*1 and 32*c*2.

Thus, if one of the three guiding members 32*a*, 32*b*, and 32*c* is moved by the sheet P, the other guides also move with the guiding member moved by the sheet P, as in the case of the first embodiment.

Incidentally, the sheet guiding means of the fixing apparatus may be made up of four or more guiding members, as long as the multiple guiding members interlock with each other as one of the guiding members is moved by the jammed recording medium. The greater the number of the sheet guiding members of the sheet guiding means of the fixing apparatus, the smaller in size each of the sheet guiding members, and therefore, the fixing apparatus is less likely to suffer from the effects of the warping of the sheet guiding members, that is, the problem that recording medium is wrapped around the heating unit because of the warping of the sheet guiding means.

Embodiment 3

Figure 6:
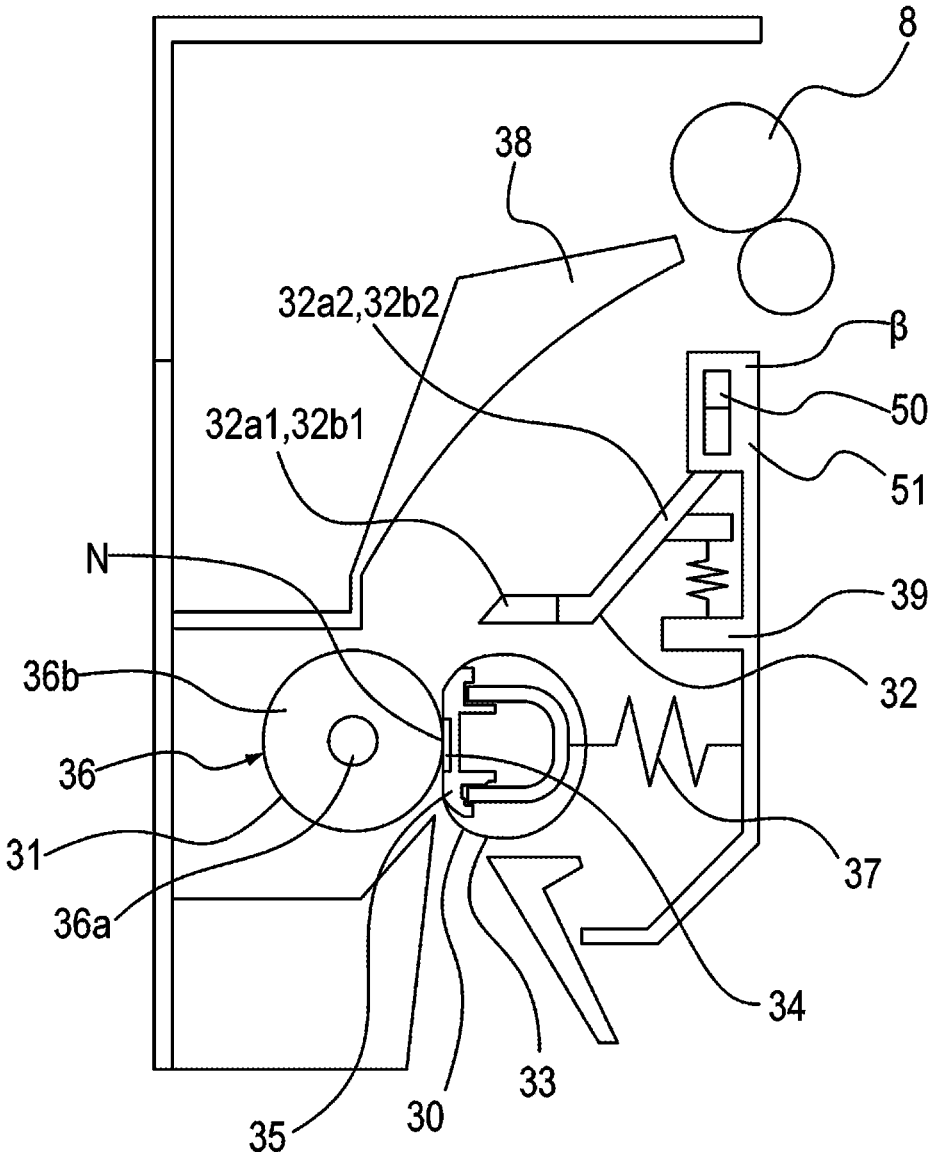
FIG. 6 is a schematic sectional view of the fixing apparatus in the third embodiment of the present invention.
Figure 7:
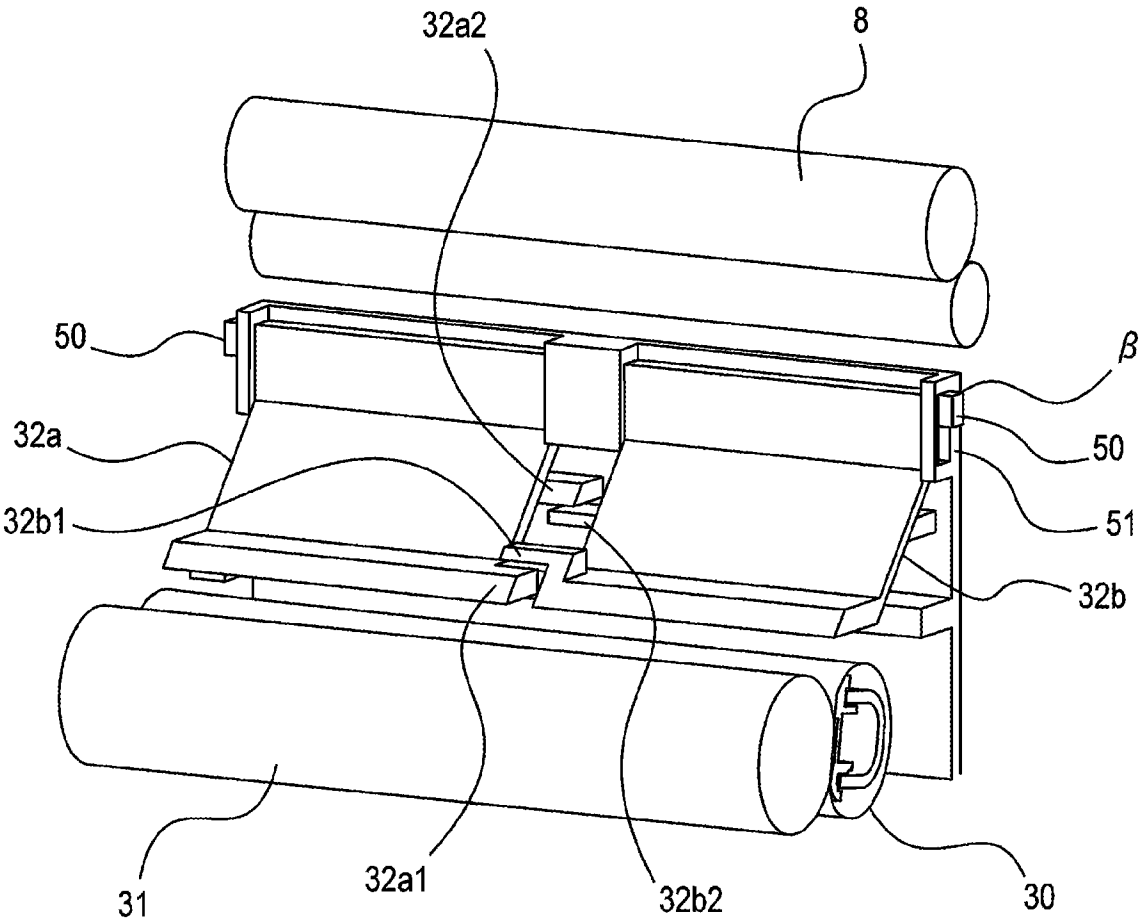
FIG. 7 is a perspective view of the fixing apparatus in the third embodiment of the present invention.
Figure 8:
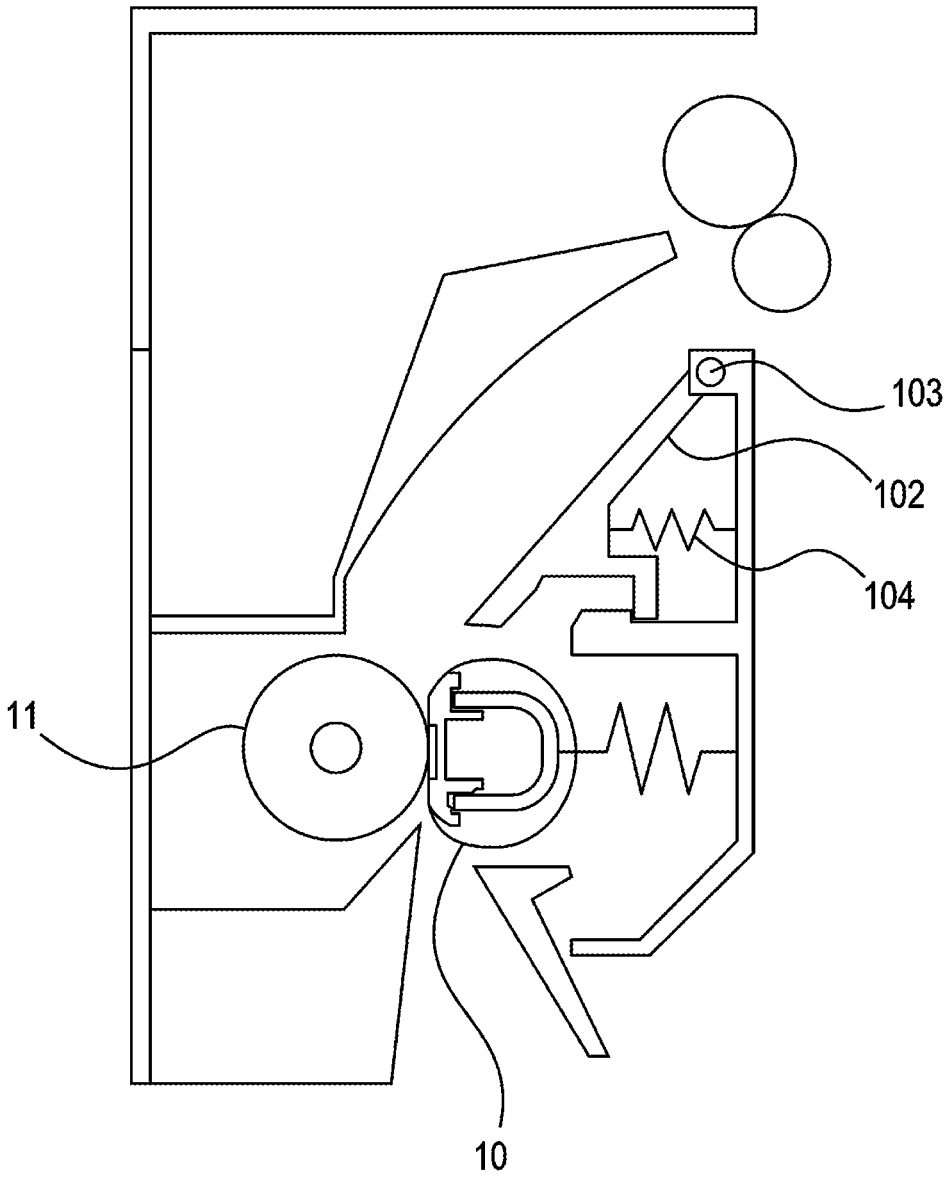
FIG. 8 is a schematic sectional view of a fixing apparatus having a conventional member for preventing a recording medium from wrapping around the heating unit of the fixing apparatus when the wrapping prevention member of the fixing apparatus is in its normal position. It shows the structure of the fixing apparatus.
Figure 9:
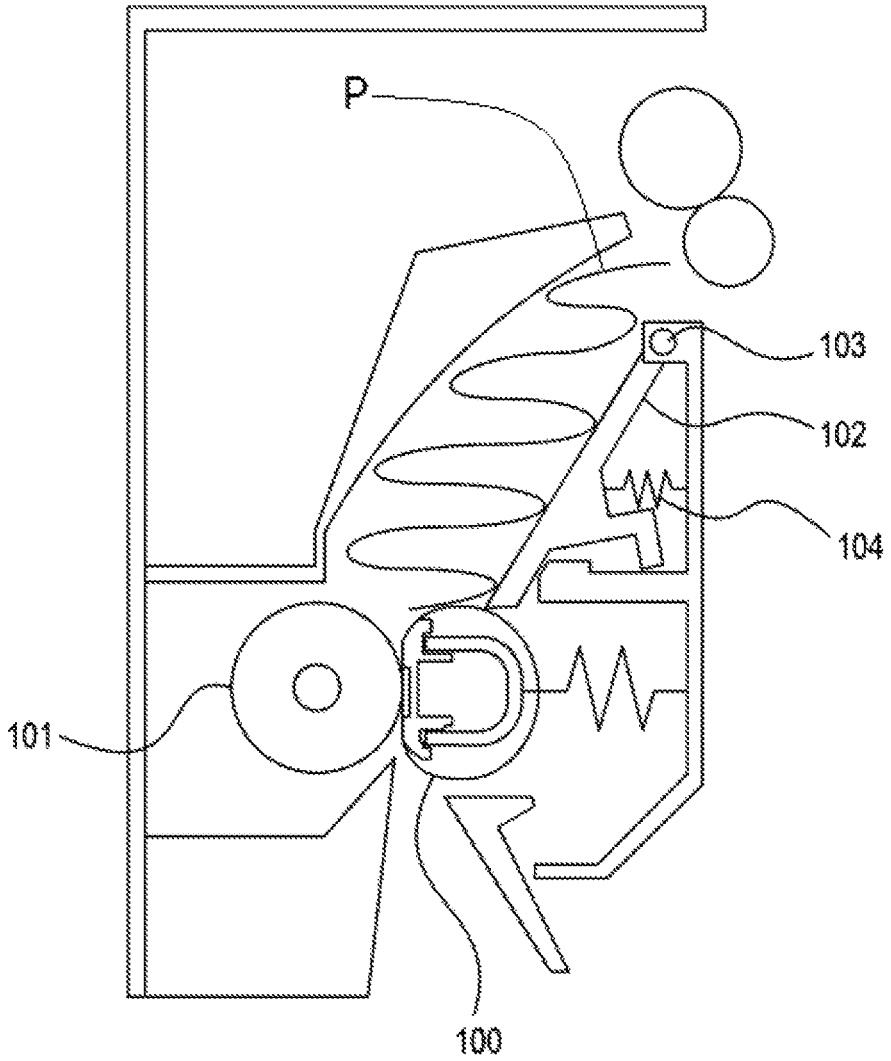
FIG. 9 is a schematic sectional view of the fixing apparatus having a conventional member for preventing a recording medium from wrapping around the heating unit of the fixing apparatus when recording medium has become jammed in the fixing apparatus. It shows the state of the wrapping preventing member of the fixing apparatus.
Figure 10:
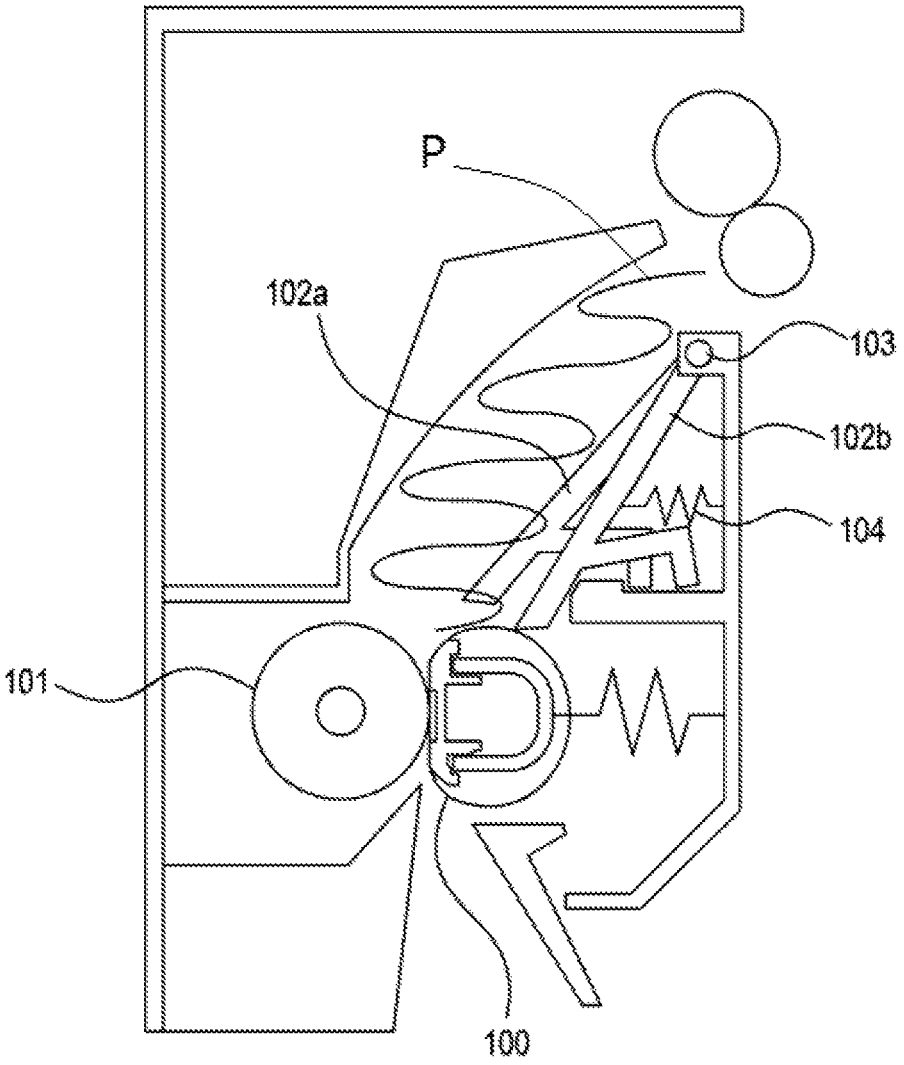
FIG. 10 is a schematic sectional view of the fixing apparatus having multiple (two, for example) wrapping prevention members, when a recording medium has become jammed in the fixing apparatus. It shows the state of the wrapping preventing member of the fixing apparatus.
Figure 11:
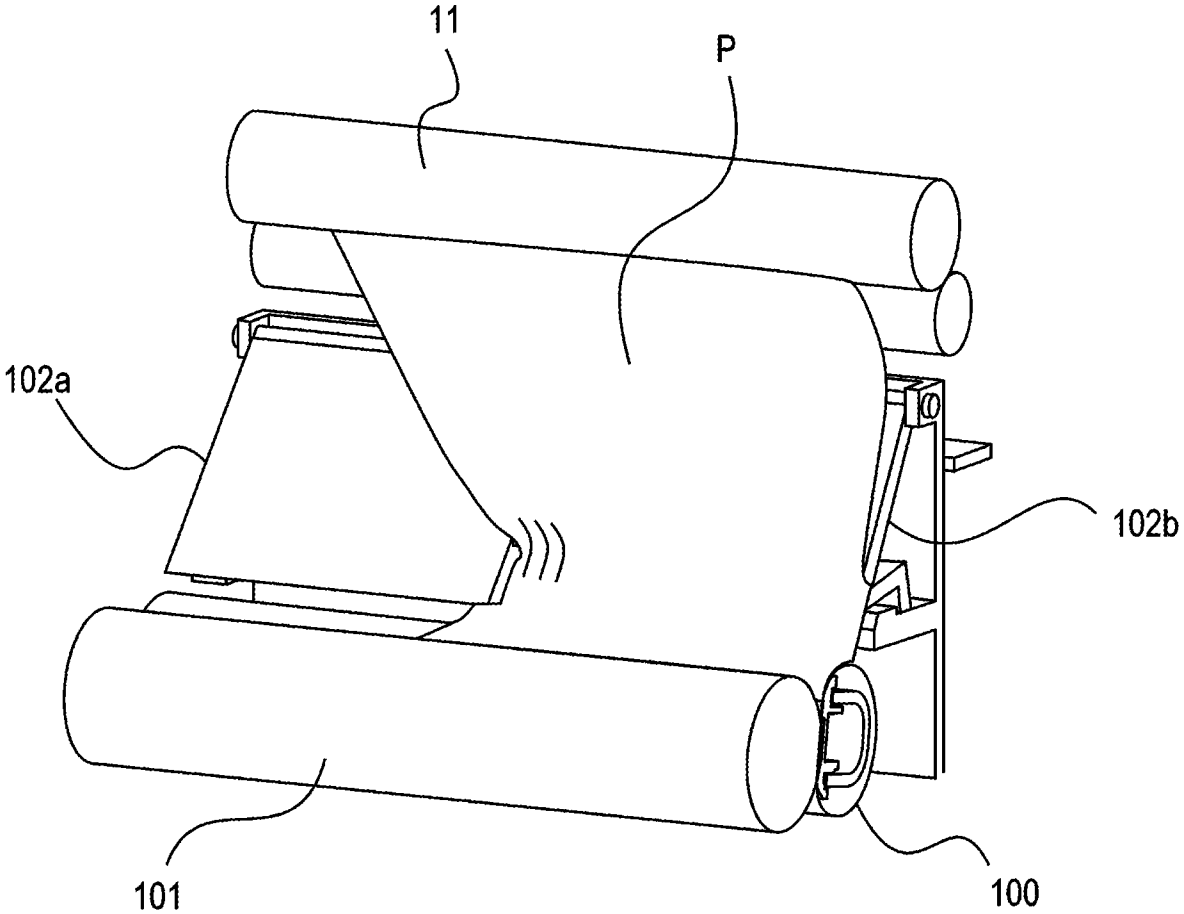
FIG. 11 is a perspective view of the fixing apparatus having multiple (two, for example) wrapping prevention members, when a recording medium has become jammed in the fixing apparatus. It shows the state of the wrapping preventing member of the fixing apparatus.

Next, referring to FIGS. 6 and 7, the fixing apparatus in the third of the preferred embodiments of the present invention is described. The fixing apparatus in this embodiment is the same as that in the first embodiment except for the structure of the guiding member 32. Therefore, the portions of the fixing apparatus in this embodiment other than the guiding member 32 are not going to be described.

Referring to FIGS. 6 and 7, the guiding means 32 in this embodiment is made up of a pair of guiding members 32*a* and 32*b*, which are referred to as the first and second guiding members, respectively. The first and second guiding members 32*a* and 32*b* are in alignment in the direction parallel to the lengthwise direction of the heating nip N, and are parallel to each other.

Each of the guiding members 32*a* and 32*b* is attached to a guiding member supporting portion which has projections 50, whereas the main frame of the fixing apparatus is provided with a pair of guiding member guiding portions 51 which have elongated holes one for one. Each projection 50 is fitted in the hole of the corresponding guiding member guiding portion 51 so that it is vertically slidable in the hole. Therefore, the guiding members 32*a* and 32*b* are vertically movable within a range which corresponds in size to the vertical dimension of the elongated hole of the guiding member guiding portion 51. Further, the guiding members 32*a* and 32*b* are kept pressured upward by a pair of springs 39. That is, the fixing apparatus is structured so that when it is in a normal state of recording-medium conveyance, each projection 50 is in contact with the seat portion β of the guiding member guiding portion 51.

The resiliency of the spring 39 is set to such a value that after the fixation of the full-color toner image to the sheet P, if the fixing apparatus suffers from a recording-medium conveyance error, such as a paper jam, and the guiding members 32*a* and 32*b* are pressed by the jammed sheet P, the guiding members 32*a* and 32*b* are downwardly moved by the jammed paper to be placed in contact with the heating unit 30.

Further, the first guiding member 32*a* is provided with a pair of tabs 32*a*1 and 32*a*2, and the second guiding member 32*b* is provided with a pair of tabs 32*b*1 and 32*b*2, as in the first embodiment. The pair of tabs 32*a*1 and 32*a*2 and pair of tabs 32b1 and 32b2 are shaped and positioned so that if the guiding member 32a (32b) vertically moves, the tabs 32a1 and 32a2 (32b1 and 32b2) interlock with the tabs 32b1 and 32b2 (32a1 and 32a2), respectively, and causes the guiding member 32b (32a) to move with the guiding member 32a (32b).

Thus, if the fixing apparatus suffers from the problem that after the sheet P is conveyed through the heating nip N, it becomes stuck between the heating nip N and pair of discharge rollers 8 because of sheet-conveyance error, the sheet P pushes one or both of the guiding members 32a and 32b downward since the sheet P has no place to go. If the amount of force applied to one of the guiding members is greater than the amount of force applied to the guiding member by the springs 39, the other guiding member is slid downward by the guiding member, which is under the pressure from the jammed paper. Consequently, the guiding members 32a and 32b come into contact with the heating unit 30, blocking thereby the passage (gap between guiding members and heating unit) which allows the sheet P to wrap around the heating unit 30.

According to the present invention, even if the fixing apparatus is provided with multiple (two, for example) sheet guiding members and is structured so that the guiding members vertically slide, the multiple guiding members can be moved together.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 038897/2010 filed Feb. 24, 2010 which is hereby incorporated by reference.

What is claimed is:

1. A fixing apparatus for fixing an image formed on the recording material, comprising:

a fixing rotatable member configured to form a fixing nip;

a plurality of wrapping preventing members, each provided downstream of the fixing nip with respect to a feeding direction of the recording material, configured to prevent the recording material from wrapping around said fixing rotatable member, wherein when the recording material is jammed downstream of the fixing nip, said wrapping preventing members move to narrow the space from said fixing rotatable member to the wrapping preventing members by being pushed by the jammed recording material, wherein said wrapping preventing members are arranged in a direction parallel with a generatrix direction of said fixing rotatable member;

wherein each of said wrapping preventing members includes a connecting portion, and wherein each of said connecting portions is configured to connect adjacent ones of said wrapping preventing members to move, so that when one of said wrapping preventing members is pushed by the jammed recording material to narrow the space, another one of said wrapping preventing members that is adjacent to the one of said wrapping preventing members is pushed by the one of said wrapping preventing members to narrow the space.

2. An apparatus according to claim 1, wherein said fixing rotatable member includes a cylindrical film.

3. An apparatus according to claim 2, further comprising a heater contacting an inner surface of said fixing rotatable member, and a pressing roller contacting an outer surface of said fixing rotatable member to sandwich said fixing rotatable member between said heater and said pressing roller.

4. An apparatus according to claim 1, wherein said wrapping preventing members move about a common axis by being pushed by the jammed recording material.

5. An apparatus according to claim 1, wherein said wrapping preventing members slide by being pushed by the jammed recording material.

6. An apparatus according to claim 1, wherein said connecting portions include tabs provided on respective wrapping preventing members, and wherein by a tab provided on said one of said wrapping preventing members pushing a tab provided on said another one of said wrapping preventing members, said another one of said wrapping preventing members is moved.

7. A fixing apparatus for fixing an image formed on the recording material, comprising:

a rotatable member configured to form a fixing nip; and first and second wrapping preventing members configured to prevent the recording material from wrapping around said rotatable member, wherein said first and second wrapping preventing members are arranged in a direction parallel with a generatrix direction of said rotatable member, wherein said first wrapping preventing member includes a first pushing portion configured to push said second wrapping preventing member, and said second wrapping preventing member includes a second pushing portion configured to push said first wrapping preventing member, and wherein when said first wrapping preventing member is pushed by the jammed recording material, said first wrapping preventing member is moved by the jammed recording material so as to narrow a space from said rotatable member to said first wrapping preventing member, and pushes said second wrapping preventing member so as to move to narrow a space from said rotatable member to said second wrapping preventing member.

8. An apparatus according to claim 7, wherein said second wrapping preventing member is pushed by the jammed recording material to move so as to narrow a space from said rotatable member to said second wrapping preventing member and to push said first wrapping preventing member so as to move to narrow a space from said rotatable member to said first wrapping preventing member.

9. An apparatus according to claim 7, wherein said first pushing portion and said second pushing portion have tab-like configurations.

10. An apparatus according to claim 7, wherein said first wrapping preventing member includes a first receiving portion configured to be pushed by said second pushing portion, and said second wrapping preventing member includes a second receiving portion configured to be pushed by said first pushing portion.

11. An apparatus according to claim 10, wherein said first and second pushing portions and said first and second receiving portions have tab-like configurations.

12. An apparatus according to claim 7, wherein said first and second wrapping preventing members move about a common axis by being pushed by the jammed recording material.

13. An apparatus according to claim 7, wherein said first and second wrapping preventing members slide by being pushed by the jammed recording material.

14. An apparatus according to claim 7, wherein said rotatable member includes a cylindrical film.

15. An apparatus according to claim 14, further comprising a heater contacting an inner surface of said rotatable member, and a pressing roller contacting an outer surface of said rotatable member to sandwich said rotatable member between said heater and said pressing roller.

16. A fixing apparatus for fixing an image formed on the recording material, comprising:

a fixing rotatable member configured to form a fixing nip; and a plurality of wrapping preventing members, each provided downstream of the fixing nip with respect to a feeding direction of the recording material, configured to prevent the recording material from wrapping around said fixing rotatable member, wherein said wrapping preventing members are arranged in a direction parallel with a generatrix direction of said fixing rotatable member, and wherein each of said wrapping preventing members includes a pushing portion, and wherein by the pushing portion provided on one of said wrapping preventing members pushing the pushing portion provided on another one of said wrapping preventing members, said another one of said wrapping preventing members is moved.

17. An apparatus according to claim 16, wherein said rotatable member includes a cylindrical film.

18. An apparatus according to claim 17, further comprising a heater contacting an inner surface of said rotatable member, and a pressing roller contacting an outer surface of said rotatable member to sandwich said rotatable member between said heater and said pressing roller.

* * * * *